US006061857A

United States Patent [19]

Deneau

[11] Patent Number: 6,061,857

[45] Date of Patent: May 16, 2000

[54] HUGGING MATTRESS WITH HOLES FOR A USER'S ARMS

[76] Inventor: Ronald Arthur Deneau, 7201 Cliff Pine Dr., Gaithersburg, Md. 20879

[21] Appl. No.: 09/266,577

[22] Filed: Mar. 11, 1999

[51] Int. Cl.[7] ..... A47C 27/00

[52] U.S. Cl. ..... 5/733; 5/690; 5/495

[58] Field of Search ..... 5/731, 733, 735, 5/695, 725, 482, 495

[56] References Cited

U.S. PATENT DOCUMENTS

| | | | |
|---|---|---|---|
| 254,759 | 3/1882 | Young | 5/731 |
| 965,637 | 7/1910 | Klimowicz et al. | 5/735 |
| 2,244,435 | 6/1941 | Simons | 5/725 |
| 3,967,335 | 7/1976 | Rhoads | 5/735 |
| 4,122,565 | 10/1978 | Hoben | 5/695 |
| 5,095,569 | 3/1992 | Glenn | 5/735 |
| 5,369,824 | 12/1994 | Powell | 5/735 |

*Primary Examiner*—Alexander Grosz
*Attorney, Agent, or Firm*—Roylance,Abrams,Berdo & Goodman, L.L.P.

[57] ABSTRACT

This invention, the hugging mattress, consists of addition of two holes to any of the otherwise conventional mattress designs. Said holes go all the way through the mattress and are rectangular or oblong and situated near each end of the mattress at the approximate shoulder and thigh positions. The function of the holes is to extend the normal pleasures of a mattress to allow hugging ones bedmate for extended periods of time or even all night long without the crushing weight one now feels on his arm. The hugging mattress will come with insertable plugs to make it a conventional mattress when the owner doesn't feel like hugging or when for safety such as when children may jump on a bed. It will also be accompanied by a bottom fitted sheet with pockets to fit the said holes.

7 Claims, 1 Drawing Sheet

HUGGING MATTRESS WITH HOLES FOR A USER'S ARMS

BACKGROUND

Mattress used for sleeping have been made in more or less the same shape and in several sizes for many years. Functions like softness, firmness, longevity, and comfort have been touted in advertisements. Different materials like feathers, foam, coil springs, water and air have been invented and produced. All these past achievements have been directed at making mattresses more sleepable or functional. Prior art is found in Class 5, Subclasses 421,690,596, 192, etc. They all overlook the fact that bedmates would sometimes like to hug for extended periods, either head to head or head to toe, without having their arms fall asleep or get sore from the crushing weight of their bed partner. This invention, the HUGGING MATTRESS is intended to permit extended hugging of a person's bedpartner.

SUMMARY OF THE INVENTION

This invention includes the addition of two holes to any ordinary mattress design commonly used with a bed. The holes protrude entirely through the mattress, one being located in the region of a sleepers shoulder and the other symmetrically placed at the opposite end of the mattress. The holes are preferably to be rectangular or oval 18 inches by 8 inches more or less and are for the purpose of allowing a person to wrap his lower arm around, or in other words to hug or embrace, his bed partner for extended time periods without the normal crushing that has always precluded this activity. The two symmetrically located holes permit the HUG MATTRESS to function when flipped or turned as is commonly recommended every several months and also permit hugging in the head to toe position. When not used for hugging the holes are to be filled with two plugs of matching or similar mattress material that are sold as an integral part of the mattress. Likewise a bottom fitted sheet with two pockets that match the holes and two small sheets for the plugs along with matching pillow cases will be sold with the mattress.

DRAWINGS

The accompanying drawings further describe the invention.

DETAILED DESCRIPTION OF THE INVENTION

Figure 1:
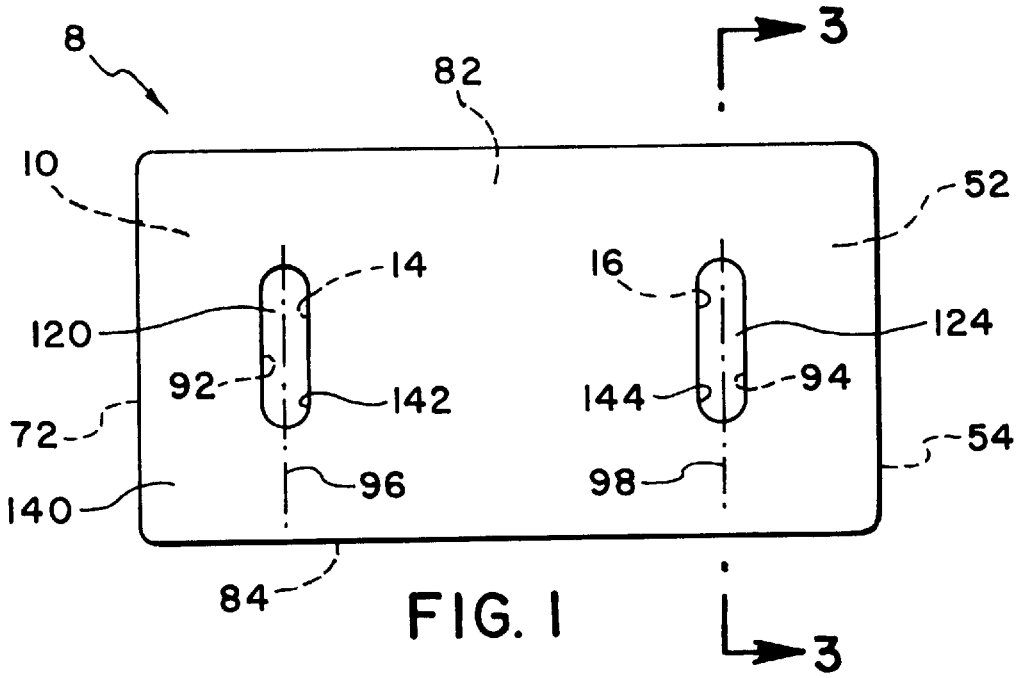
FIG. 1 shows a plan view looking down on the hugging mattress and showing the novel addition of two holes with filler plugs. The plugs can either be full or half depth of the mattress resulting in two or four plugs respectively.
Figure 2:
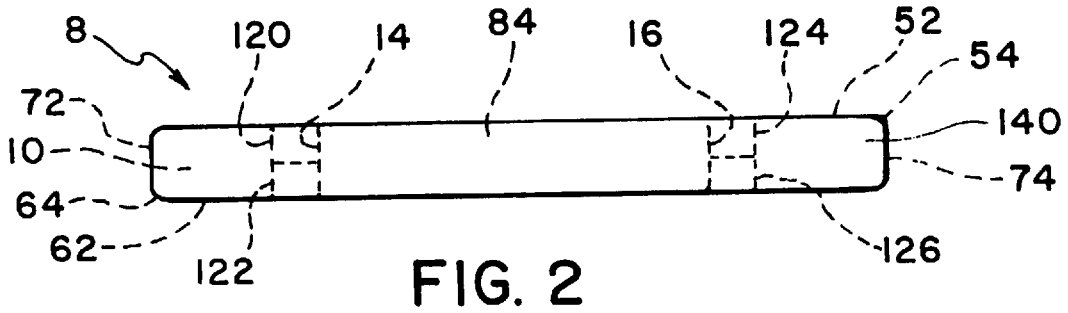
FIG. 2 shows a side elevation of the mattress with the plugs in place.
Figure 3:
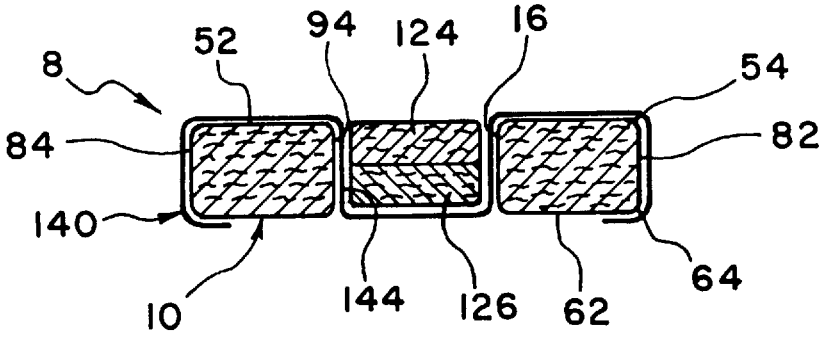
FIG. 3 shows a cross-sectional view of the mattress taken along line 3—3 in FIG. 1 and shows the plugs removed and a fitted sheet with two pockets to match the holes in the mattress.

This invention includes of the addition of two holes to the construction of any normal mattress for sleeping on a bed. The purpose for the holes 14 and 16 is to allow either or both persons to hug their bedmate for extended periods, or even all night long, with their lower arm without the normal crushing pain from the weight of their partner. The two holes 14 and 16, symmetrically located, permit the mattress 10 to be turned or flipped and also permit hugging ones bedmate in a head to toe position.

A mattress and sheet assembly 8 has a mattress 10 covered by a sheet 140. Mattress 10 has an upper surface 52 with a perimeter 54 and a lower opposite surface 62 with a perimeter 64. Mattress 10 also has two relatively shorter sides 72 and 74 and two relatively elongated sides 82 and 84. As with typical mattresses, the shorter sides 72 and 74 are generally parallel to each other and the elongated sides 82 and 84 are generally parallel to each other. The sides 72, 74, 82 and 84 are coupled to surfaces 52 and 62 along their respective perimeters 54 and 64.

Holes or passageways 14 and 16 extend completely through mattress 10 between the upper surface 52 and said lower surface 54. Hole 14 has a wall 92 extending between the upper surface 52 and the lower surface 62. Hole 14 is preferably oval or rectangular and has a longitudinal axis 96, which is preferably, approximately twenty inches from the shorter side 72. Longitudinal axis 96 is generally parallel to shorter side 72. Hole 16 has a wall 94 extending between the upper surface 52 and the lower surface 62. Hole 16 is preferably oval or rectangular and has a longitudinal axis 98, which is preferably, approximately twenty inches from the shorter side 74. Longitudinal axis 98 is generally parallel to shorter side 74. Therefore, holes 14 and 16 are symmetrically positioned on each surface 52 and 62 so that the mattress 10 gives the same effect for the user regardless of which side or orientation of the mattress is used.

The hugging mattress is to be provided with two full depth or four half depth plugs 120, 122, 124 and 126 to fill the holes 14 and 16 if desired when not used for hugging. This will make it safe for children jumping on the bed for example. The plugs 120, 122, 124 and 126 will be of the same or similar mattress 10 material or foam filled. Each hugging mattress will also be accompanied by a fitted bottom sheet 140 with two pockets 142 and 144 matching the said holes 14 and 16.

The drawings show the approximate size, shape and spacing of the holes 14 and 16 but the essence is that they be arranged to allow comfortable hugging of ones bedmate for extended periods of time. Extra padding of will be required around the edges of holes 14 and 16 to soften corners. Also the holes 14 and 16 shall not be so large as to materially interfere with sleeping in the normal positions when not hugging a bedmate.

It is proposed that the hugging mattress 10 be manufactured, by the simple addition of the sewing machine necessary to sew the hugging mattress liner and cover around the holes and the fabrication of the two or four removable plugs 120, 122, 124 and 126.

I claim:

1. A mattress for receiving an arm of a user, comprising:

an upper surface having a perimeter;

a lower surface having a perimeter and being opposite said upper surface;

two generally parallel elongated sides;

two generally parallel shorter sides, said two elongated sides and said two shorter sides coupling said upper and lower surfaces around said perimeter of said upper surface and said perimeter of said lower surface;

an elongated first passageway extending completely through said mattress between said upper surface and said lower surface, said first passageway having a first wall extending between said upper and said lower surfaces and defining said first passageway and a longitudinal axis extending generally parallel to said two short sides; and an elongated second passageway extending completely through said mattress between said upper surface and said lower surface, said second passageway having a second wall extending between said upper and said lower surfaces and defining said second passageway and a second longitudinal axis extending generally parallel to said two shorter sides.

2. A mattress according to claim 1, further comprising:

first and second plugs adapted to be inserted into said first passageway.

3. A mattress according to claim 1, wherein said first and second passageways are symmetrically positioned on each of said upper and lower surfaces.

4. A mattress according to claim 3, wherein said two shorter sides include a first shorter side and a second shorter side, and said first passageway is positioned closer to said first shorter side than said second shorter side and said second passageway is positioned closer to said second shorter side than said first shorter side.

5. A mattress for receiving an arm of a user, comprising:

an upper surface;

a lower surface opposite said upper surface;

first and second shorter sides;

first and second elongated sides;

a first hole extending completely through said mattress between said upper surface and said lower surface and being positioned closer to said first shorter side than to said second shorter side; and a second hole extending completely through said mattress between said upper surface and said lower surface and being positioned closer to said second shorter side than to said first shorter side, said first and second holes being symmetrically positioned on each of said upper and lower surfaces.

6. A mattress according to claim 5, wherein said first hole is elongated and has a first longitudinal axis, and said second hole is elongated and has a second longitudinal axis.

7. A mattress according to claim 6, wherein said first longitudinal axis is substantially parallel to said second longitudinal axis.

* * * * *